US008365953B2

(12) United States Patent
Calvo et al.

(10) Patent No.: US 8,365,953 B2
(45) Date of Patent: Feb. 5, 2013

(54) CAULKING GUN HAVING ADJUSTABLE HANDLE AND ACTUATING AND RESTRAINING MECHANISM

(76) Inventors: Rafael Adolfo Calvo, Altadena, CA (US); Janet Ellis Calvo, Altadena, CA (US)

( * ) Notice: Subject to any disclaimer, the term of this patent is extended or adjusted under 35 U.S.C. 154(b) by 0 days.

(21) Appl. No.: 13/190,436

(22) Filed: Jul. 25, 2011

(65) Prior Publication Data

US 2012/0018457 A1 Jan. 26, 2012

Related U.S. Application Data

(63) Continuation of application No. 11/698,735, filed on Jan. 26, 2007, now Pat. No. 8,006,867.

(60) Provisional application No. 60/763,469, filed on Jan. 27, 2006.

(51) Int. Cl.
*B67D 1/00* (2006.01)

(52) U.S. Cl. ..... 222/82; 222/83; 222/232; 222/391; 74/144

(58) Field of Classification Search ..... 222/80–83, 222/83.5, 88, 173, 175, 323–327, 386, 389–393, 222/465.1, 466, 467, 469; 269/6, 212, 214; 74/111, 130, 141.5, 144, 148, 155, 156
See application file for complete search history.

(56) References Cited

U.S. PATENT DOCUMENTS

| | | | | | |
|---|---|---|---|---|---|
| 2,877,935 | A * | 3/1959 | Sherbondy | 222/326 |
| 3,189,226 | A * | 6/1965 | Sherbondy | 222/82 |
| 3,439,839 | A * | 4/1969 | Schumann et al. | 222/95 |
| 3,606,085 | A * | 9/1971 | Spilman | 222/43 |
| 3,606,100 | A * | 9/1971 | Stapf | 222/320 |
| 4,081,112 | A * | 3/1978 | Chang | 222/391 |
| 4,135,644 | A * | 1/1979 | Pacetti | 222/81 |
| 4,390,115 | A * | 6/1983 | Bigham | 222/326 |
| 4,493,437 | A * | 1/1985 | Breeden | 222/82 |
| 4,957,223 | A * | 9/1990 | Beilush | 222/340 |
| 5,052,314 | A * | 10/1991 | Leini | 111/106 |
| 5,217,213 | A * | 6/1993 | Lii | 269/6 |
| 5,361,946 | A * | 11/1994 | Ginther et al. | 222/175 |
| 5,875,920 | A * | 3/1999 | Parent | 222/1 |
| 6,045,005 | A * | 4/2000 | Stratton | 222/83.5 |
| 6,056,156 | A * | 5/2000 | Peng | 222/82 |
| 6,070,809 | A * | 6/2000 | Price | 239/273 |
| 6,464,109 | B1 * | 10/2002 | Harris | 222/160 |
| 6,474,632 | B1 * | 11/2002 | Liou | 269/6 |
| 6,640,998 | B1 * | 11/2003 | Kern | 222/87 |
| 6,672,489 | B1 * | 1/2004 | Huang | 222/391 |
| 6,691,899 | B2 * | 2/2004 | Sung | 222/391 |
| 6,908,016 | B2 * | 6/2005 | Chen | 222/391 |
| 7,364,054 | B2 * | 4/2008 | Klein | 222/334 |
| 2004/0004093 | A1 * | 1/2004 | Sung | 222/391 |
| 2006/0043660 | A1 * | 3/2006 | Ping | 269/6 |
| 2009/0218372 | A1 * | 9/2009 | De Man et al. | 222/391 |

* cited by examiner

*Primary Examiner* — Kevin P Shaver
*Assistant Examiner* — Patrick M Buechner
(74) *Attorney, Agent, or Firm* — Strategy IP, A Professional Law Corp

(57) ABSTRACT

A dispensing tool for dispensing material from a cartridge includes a cartridge holder defining an opening sized to receive the cartridge and including a cartridge rail. The tool further includes a plunger coupled to the cartridge holder such that it is movable axially through the cartridge holder opening, a plunger restraining member coupled to the cartridge holder, a handle coupled to the cartridge rail, and a trigger pivotably coupled to the handle. The handle may be repositionable along the cartridge rail and the plunger restraining member may disengage with the plunger to allow axial movement when the trigger is pivoted relative to the handle.

23 Claims, 8 Drawing Sheets

CAULKING GUN HAVING ADJUSTABLE HANDLE AND ACTUATING AND RESTRAINING MECHANISM

CROSS-REFERENCE TO RELATED APPLICATION

This patent application is a Continuation of U.S. Ser. No. 11/698,735, filed Jan. 26, 2007 and issued as U.S. Pat. No. 8,006,867, which claims the priority benefit of provisional application 60/763,469, filed Jan. 27, 2006. Each of the foregoing is incorporated by reference herein in its entirety.

FIELD OF THE INVENTION

The invention described below relates to hand tools and, more particularly, to manually actuated caulking guns.

BACKGROUND OF THE INVENTION

Caulking guns have been developed to provide a convenient way to dispense caulking or silicone compounds from cartridges. The cartridges themselves are generally made with a built-in plastic nozzle and provide a sliding plug on the opposite end of the nozzle. Caulking guns generally include a cartridge holder, a plunger with a shaft for pushing the compound in the cartridge, a handle and a trigger mechanism for advancing the plunger. Once the tip of a nozzle is cut, the seal of a cartridge broken using a poker and the cartridge has been placed in the gun, a user squeezes the trigger, advancing the plunger. The plunger in turn pushes the plug and the cartridge extrudes compound. The previous art generally includes a handle and a plunger advancing mechanism towards the back end of the gun. These guns commonly use two coil springs to achieve the tensions necessary on the plunger's parts. Some more sophisticated guns have "no drip" features that release the pressure on the plungers so that compound does not leak from the nozzles when not in use. Current automatic pressure release mechanisms use additional springs and parts to relieve pressure on the cartridge. These mechanisms relieve a plunger's pressure each time a trigger is released. Other guns require a user to depress a tab to release pressure on the cartridges. Some caulking guns include built-in nozzle (snout) cutters. U.S. Pat. No. 6,045,005 describes a circular opening in the side of a handle with a blade on a trigger for cutting the tip of a nozzle. Although a need for simple construction has been noted in the prior art, multiple coil springs have remained common to most caulking guns, some using as many as three springs, cables, ratchets and tabs which a user must activate to operate.

The construction and operation of common caulking guns necessitate a user to hold the gun with both hands for accurate delivery of compound. Usually one hand cradles a cartridge holder and cartridge; the hand's position supports the majority of the gun's weight. The other hand grips a handle and squeezes a trigger. Although this method of operation is adequate for many uses, some applications do not readily allow a user to hold a gun with both hands. In such cases, a user must support the weight of the entire gun with one hand putting added stress on the user's wrist and making precise delivery of compound more difficult. Some situations call for a user to use one hand for bracing his/her own body and only use a gun with the other hand, for example while standing on a ladder. Other situations call for a user to hold an object with one hand and apply compound with a gun in the other hand. In these cases, the user must draw back the hand holding the gun to align a nozzle's tip with the object being held. Operating a common caulking gun in a drawn back position is awkward, potential imprecise and may quickly fatigue a user's wrist.

Although the usual design of caulking guns includes a handle and trigger at the rear, two patents show variations of this arrangement. U.S. Pat. No. 6,640,998 describes a device wherein a cartridge holder slides back against a non-moving plunger. Although this action claims to improve the balance of their invention during use, the entire weight of a full cartridge still hangs in front of a user's hand when a new cartridge is placed in the device. Furthermore, this design has the drawback that as a trigger is squeezed, a nozzle's tip pulls away from the point of contact. This motion requires that a user constantly adjust the gun forward during use. U.S. Pat. No. 4,957,223 describes a handle that is placed towards the front of a caulking gun and uses a complex combination of springs and cables to cause it to function. This design may allow for a better balance at the beginning of use if only one hand holds such a gun, but the device does not allow for the option to operate it by the method of cradling the gun with one hand and gripping the handle with the other hand.

BRIEF SUMMARY

It is, accordingly, one object of the present invention to provide a caulking gun whose balance point is adjustable.

Another object of the present invention is to provide the ability to adjust the balance point even while a cartridge remains in a cartridge holder.

Another object of the present invention is to be usable and balanced with either a two-handed grip or single-handed grip.

Another object of the present invention is to provide a sliding handle for adjusting and setting the balance point of a gun.

Another object of the present invention is to provide a simple mechanism for the disengagement and reengagement of a handle from an upper body of the gun using a trigger.

Still another object of the present invention is to reduce the number of springs in the advancing and restraining mechanisms by eliminating the need for multiple springs, and instead use one spring.

Another object of the present invention is to provide a simple automatic means to relieve pressure on a cartridge to prevent oozing after a trigger is squeezed and released without the need for additional springs.

Yet another object of the present invention is to move the location of a nozzle cutter away from the inside of a handle where plastic nozzle tips and caulking compound may lodge; and to move it to the front of a gun where it is more visible, in alignment with a handle and where cut nozzle tips will not be trapped.

Another object of the present invention is to provide an arm support clip that may be employed or left in a retracted position.

Still another object of the present invention is to provide a design that is easy to manufacture and assemble.

One embodiment of a design of this invention has a cartridge holder portion which includes a front disk with an opening for a cartridge nozzle, an upper cartridge rail and a lower cartridge rail, both extend rearward and parallel to each other from the front disk, a hollow stock portion connected to the upper cartridge rail wherein is found a dual function spring, an actuating plate, a restraining plate and a plunger shaft that passes through the stock and each plate.

A handle and trigger are positioned below a cartridge holder and stock, and can slide along a lower cartridge rail. A plunger advancing means connects a trigger and an actuator plate such that it causes the actuator plate to move forward when the trigger is squeezed, yet allows adjustment of the handle's position should a user prefer a different balance point for the gun.

Two separate functions are required to allow a handle to slide: First, a handle repositioning means must be able to disengage a handle from a gun's lower cartridge rail, allow the handle to move to a new position, and then reengage the handle. Second, a plunger advancing means must permit a trigger to disengage from a plunger advancing means, allow a handle to be moved to a new position, and then reengage the trigger to the plunger advancing means.

Here described are four embodiments of mechanisms that connect a handle to the rest of a gun and a trigger to a plunger advancing plate.

In a first embodiment, these two actions must be performed separately; each action designed to operate independently using fasteners that engage a handle into indentations in a lower cartridge rail and fasteners that engage a trigger into indentations in a connecting bar (otherwise referred to as a trigger bar) that extends back to a plunger advancing plate. Two examples of fastener types include locking tabs that slide up or down, or thread screws. A user is required to release a fastener that locks a handle to a gun, release a fastener that connects a trigger to a trigger bar, move the handle's position, then re-lock each fastener.

In a second embodiment, two separate sprung tabs engage a handle to indentations in a lower rail and a trigger to indentations in a trigger bar. These tabs are placed in alignment such that as a user pushes a button at the rear of said handle, a shaft, connected to said button and positioned inside said handle, engages said tabs. Said shaft moves forward, collapses said tabs simultaneously, permitting said handle to be positioned at a different point along the gun; releasing said button resets said tabs against said indentations. This arrangement requires that both tabs align with their respective indentations simultaneously for a handle and trigger to be reengaged for use.

With a third embodiment, a spool, positioned transversely to a handle, is connected to a trigger. A thin cable wraps around said spool, extends back, and is connected to a tab in a plunger advancing plate. When said trigger is squeezed, rather than spin, said spool locks and is pushed forward. To release said handle for repositioning along the gun, a forked tab attached to said handle slides up and down, releasing said handle from a lower cartridge rail. As said handle slides, said spool automatically picks up or releases slack on said cable as needed.

A fourth and preferred embodiment provides a sliding vertical forked tab at the rear of a handle, said tab engaging indentations in a lower cartridge rail; and a trigger including a toothed extension, a trigger bar having indentations, the extension and trigger bar indentations engaging only when the trigger is squeezed. A coil spring is positioned inside the trigger. One end of the coil spring biases the trigger away from the handle while the other end of the coil spring is attached to the tab. With this arrangement, a handle can be released, moved and then relocked in one easy maneuver using only a trigger.

Attached to the lower forward portion of a lower cartridge rail, a trigger bar bracket includes an opening to receive and support the front edge of a trigger bar, the front edge of said bar being sharpened or including a small blade. Another opening in the bracket allows nozzles of common cartridges to be inserted therein. The sharpened edge of the trigger bar and the body of the bracket thus form a guillotine type nozzle cutter.

A plunger restraining plate includes a leg extending rearwards and straddles the upwardly sloping rear portion of a trigger bar. As the trigger bar begins moving forward when a trigger is squeezed, it engages the leg, lifting it slightly releasing the plunger shaft. As the trigger is released, the actuator plate again lifts the leg of the restraining plate thereby delaying the restraining plate from locking onto the plunger shaft, thus permitting the shaft to slide rearwards slightly, relieving pressure on a cartridge. This action occurs automatically each time a trigger is released after being squeezed.

An arm clip, pivotally attached to a stock, gives an optional second point of contact with a user's arm to firmly secure the gun to the forearm of the user, while also providing greater support, accuracy and endurance.

Although multiple springs may be used to produce the actions necessary for the actuator plate and restraining plate to function, a single dual action spring design reduces the number of springs necessary to actuate the plates and simplifies the construction of the gun. The single spring design of the current invention is employable with a gun that does not have a sliding handle. In a preferred embodiment, a caulking gun includes a sliding handle, is manufactured as simply as possible and allows for both a handle and trigger to release for adjustment with one simple maneuver.

DETAILED DESCRIPTION OF THE ILLUSTRATED EMBODIMENTS

Figure 1:
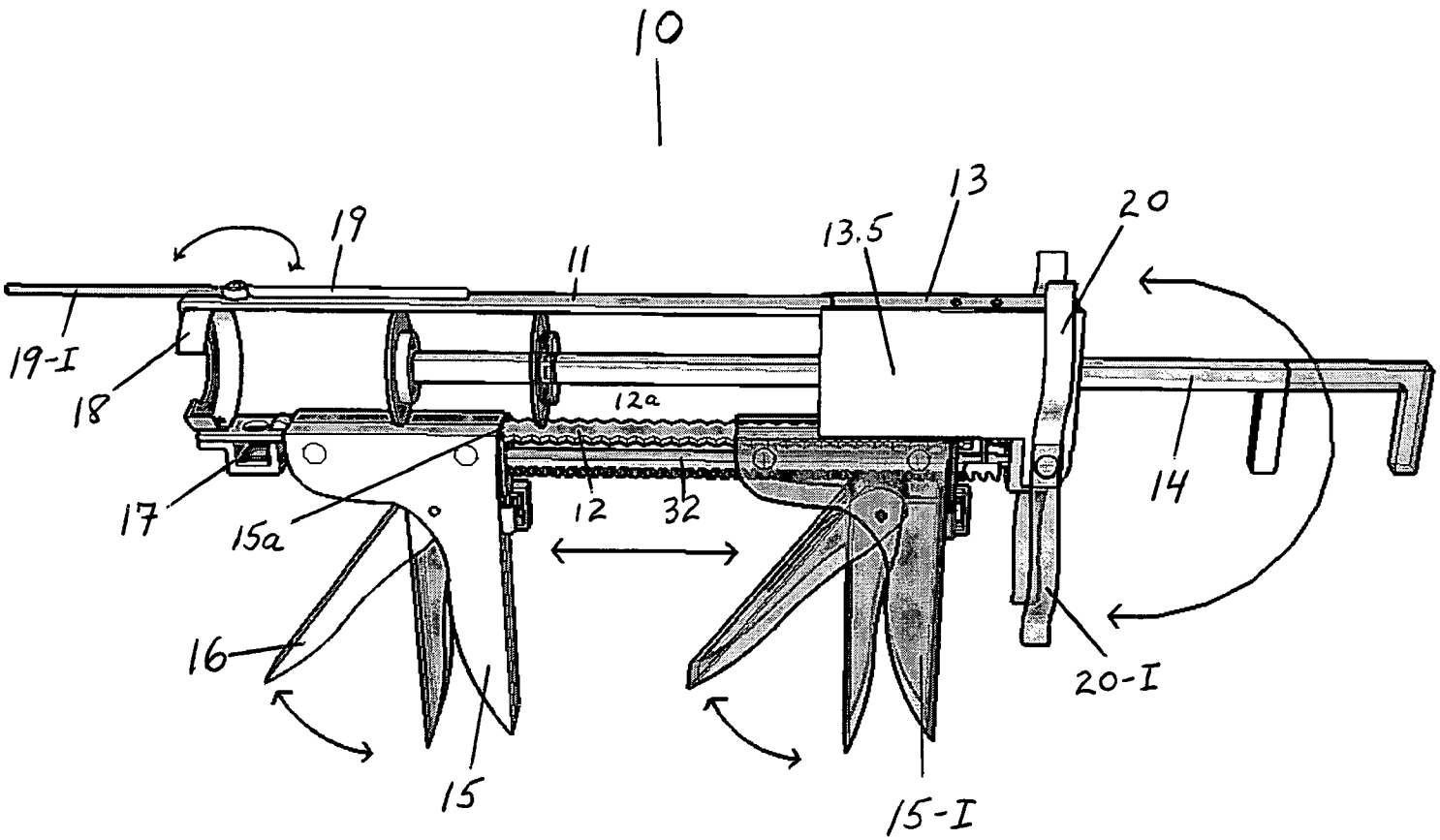
FIG. 1 is a side elevation, general view of a caulking gun with a sliding handle, shown set forward and shadowed in the rearward position, a pivotally mounted arm clip set upward and shadowed in the downward position, a pivotally mounted cartridge poker set retracted and shadowed in the extended position, and a nozzle cutter located near the front of the invention, away from the inside of said handle.

Referring to the drawings, in particular to FIG. 1, there is shown generally at (10) a caulking gun incorporating features of the invention. The upper body of caulking gun (10) includes a cartridge holder defined by a disk (18) upper cartridge rail (11) and lower cartridge rail (12). A stock (13) with stock cover plate (13.5) wherein the cover plate overlaps and attaches to upper cartridge rail (11). Plunger shaft (14) passes through stock (13) and upper cartridge rail (11). Cartridge poker (19), pivotally mounted on upper cartridge rail (11), may be rotated 180 degrees forward, shown shadowed in forward position as poker (19-I). Arm clip (20), pivotally attached to stock (13), may be turned downwards 180 degrees, shown shadowed in downward position as clip (20-I).

A sliding handle (15) with trigger (16) includes sleeve (15*a*), permitting lower cartridge rail (12) to pass there through. Lower cartridge rail (12) includes indentations (12*a*) along its long axis. Handle (15) may be set anywhere along lower cartridge rail (12) at any given indentation (12*a*). Handle (15) also shown shadowed in the rearward position as handle (15-I). Nozzle cutter (17), attached to rail (12), supports the front edge of trigger bar (32). While this embodiment of the invention is described in terms of a caulking gun, one having ordinary skill in the art will understand that the invention is not limited to devices dispensing caulking only, but may be applied to other dispensing devices as claimed herein.

Figure 2:
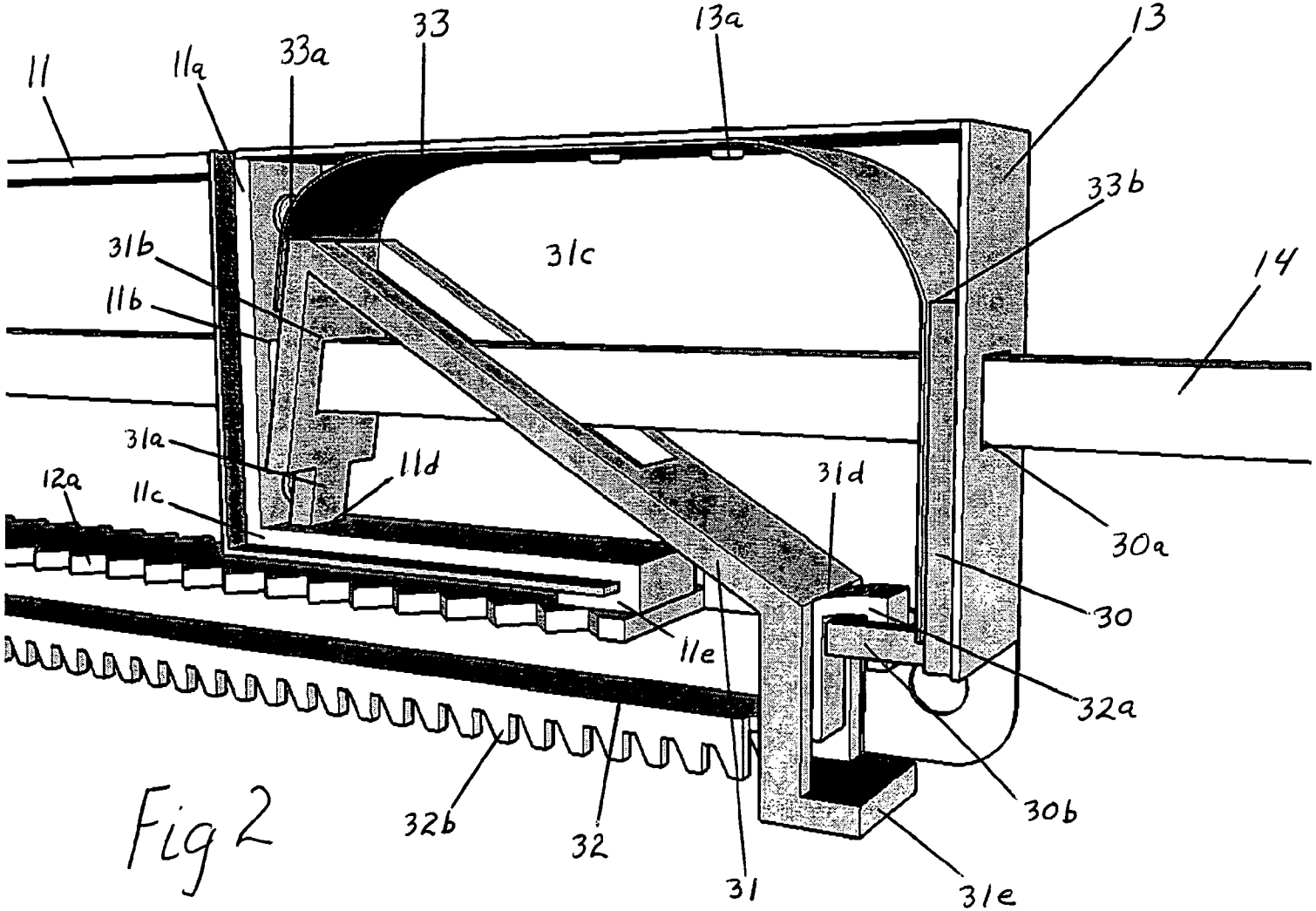
FIG. 2 is a side, sectional, perspective, inside view of a stock with stock cover removed, including an actuator plate, a restraining plate, a dual function leaf spring, trigger bar and plunger shaft.

Referring now to FIG. 2, there is shown a stock (13) with cover plate (13.5) having been removed for viewing, the upper cartridge rail (11) bends downward at point (11*a*); has a first hole or opening (11*b*) through which plunger shaft (14) passes, bends rearward again at point (11*c*) and contacts lower cartridge rail (12) at point (11*e*). Plunger restraining plate (31) is anchored with foot (31*a*) to upper cartridge rail (11) at point (11*d*); extends upwards; has opening (31*b*) through which plunger shaft (14) passes; and includes a leg that extends rearward and downward, plunger shaft (14) again passing through unrestricted at point (31*c*); bends downward and is forked at point (31*d*) leaving an angled plane to contact trigger bar (32) at a point (32*a*) only when trigger bar (32) moves forward; straddles trigger bar (32) bending rearward again and terminating with tab (31*e*). Plunger advancing plate (30) extends downward, has plunger shaft (14) pass through at a second hole or point (30*a*), extends further downward terminating with tab extension (30*b*). Actuator leaf spring (33) is attached to the upper inside plane of stock (13) at point (13*a*); contacts restraining plate (31) at point (33*a*) exerting rearward pressure on plate (31); and contacts actuator plate (30) at point (33*b*) exerting rearward pressure on plate (30). As trigger bar (32) moves forward when a trigger is squeezed, sloped segment (32*a*) forces plate (31) upwards at point (31*d*). Said motion releases shaft (14) at point (31*b*). As trigger bar (32) slides rearward when the trigger is released, plate (31) remains slightly elevated and is delayed in contacting shaft (14).

Figure 3:
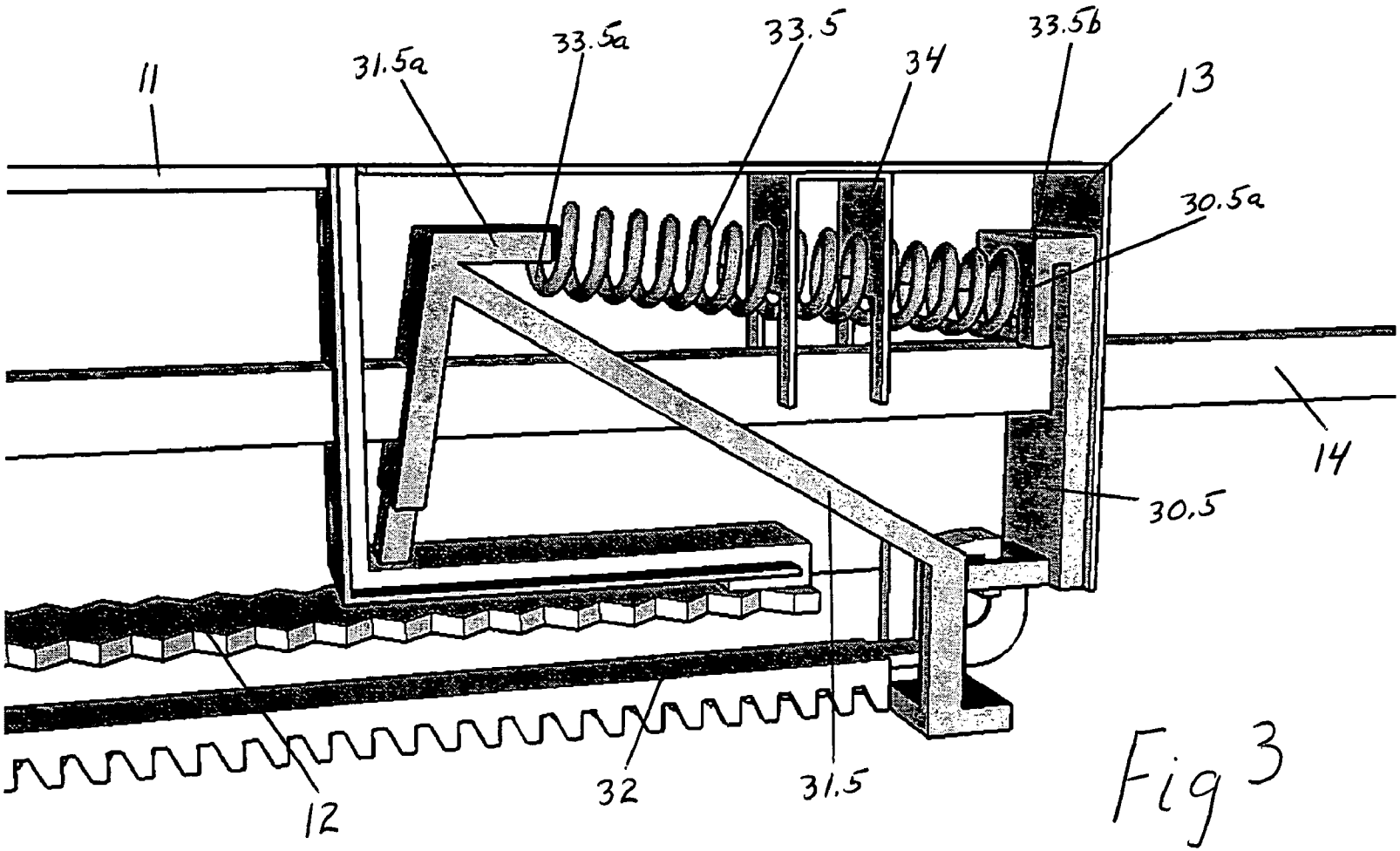
FIG. 3 is a side, sectional, perspective, inside view of a stock with stock cover removed, including actuator plate, restraining plate, an dual function coil spring, trigger bar and plunger shaft.

Referring now to FIG. 3, there is shown a second embodiment of an actuator spring using a coil spring (33.5) attached to stock (13) with bracket (34). Said spring attached to restraining plate tab (31.5*a*) at point (33.5*a*) and attached to plate (30.5) at point (33.5*b*); plate (30.5) using plate tab (30.5*a*) to keep spring (33.5) in place.

Figure 4:
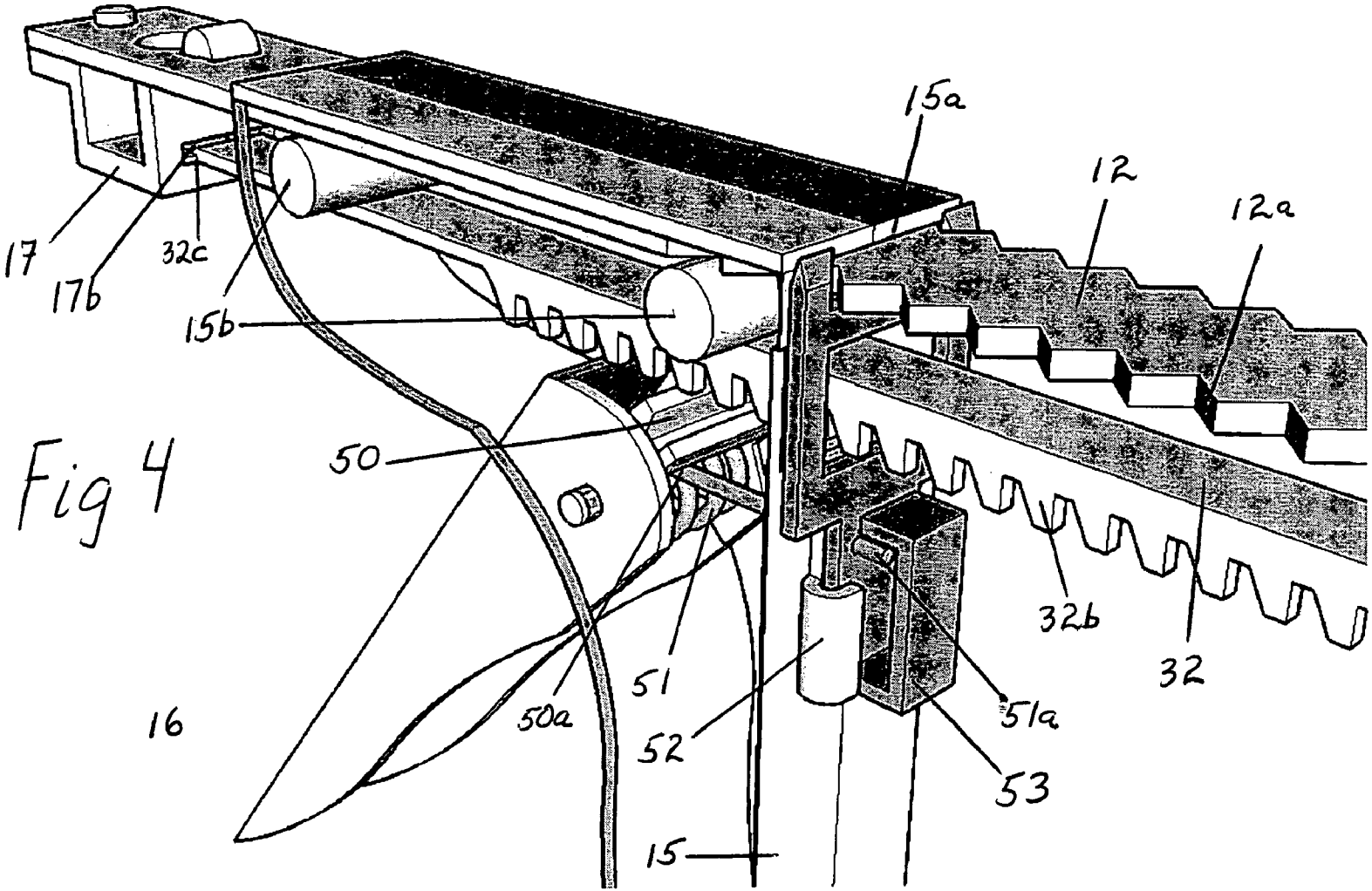
FIG. 4 is a side, sectional, perspective, inside exposed view of a handle, its side wall removed for viewing, including a handle sleeve, a trigger, trigger indentations, trigger spring, forked tab, tab bracket and a nozzle cutter.

Referring now to FIG. 4, there is shown a cross sectional view of a handle (15) which includes sleeve (15*a*) through which lower rail (12) passes there through, the monorail alignment secured with fasteners (15*b*). Forked tab (53) slides along bracket (52) and engages lower rail (12) at any of a series of indentations (12*a*). Spring (51), positioned inside trigger (16) engages tab (53) with spring end (51*a*). The upper portion of the trigger including indentations (50), positioned inside trigger (16) and straddling spring (51), contacts spring (51) at point (50*a*). The trigger indentations (50) engage trigger bar indentations (32*b*) only when trigger (16) is squeezed, as both trigger (16) and trigger indentations (50) rotate more vertically. When trigger (16) is lifted away from handle (15), the upper portion of the trigger (50) pushes spring end (51*a*) downward; spring end (51*a*) pushes tab (53) downward, disengaging tab (53) from rail indentations (12*a*). Trigger bar (32) extends forward, terminating at opening (17*b*) of bracket (17). A sharpened edge with blade (32*c*) rests on the edge of bracket (17).

Figure 5:
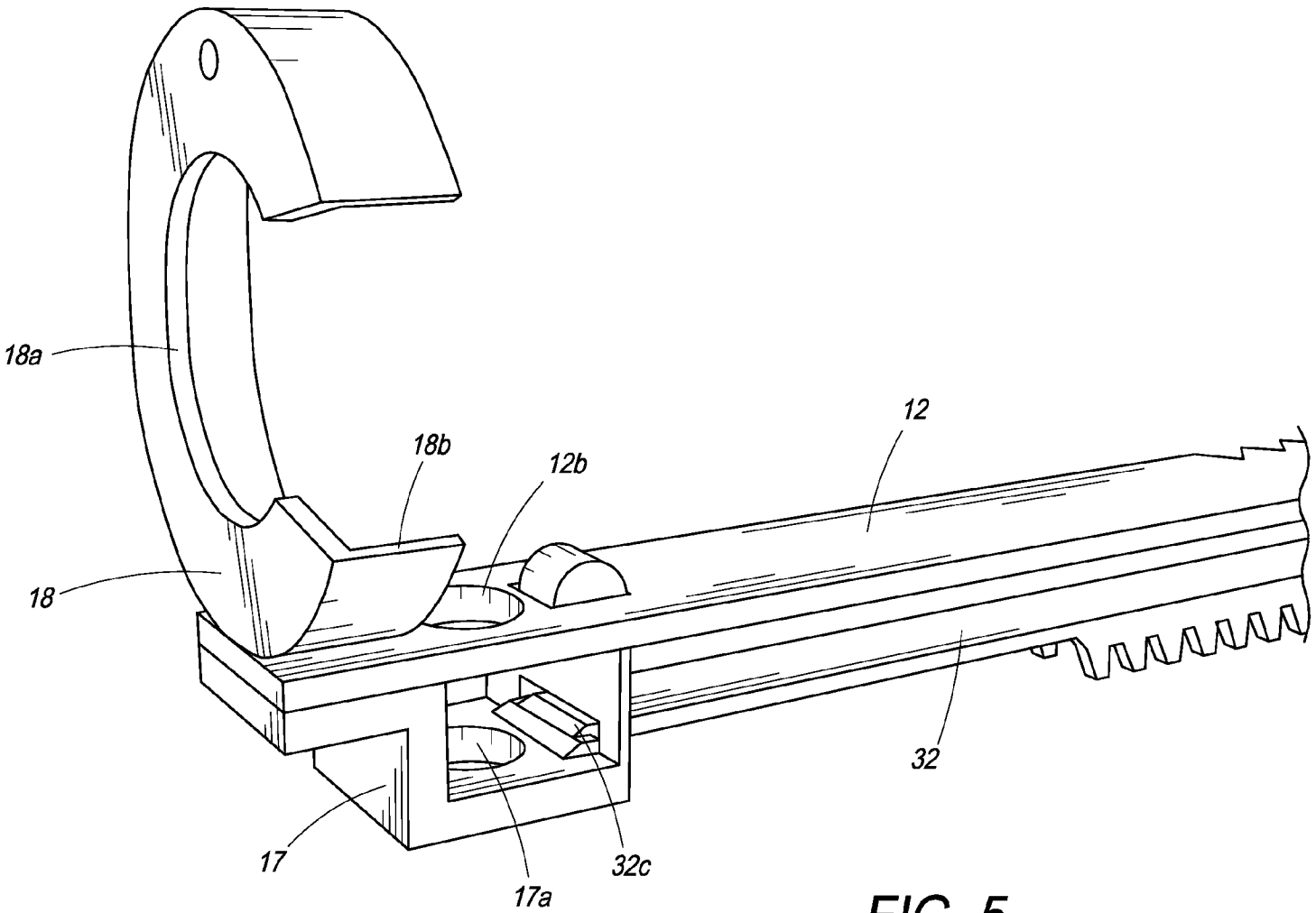
FIG. 5 is a side, sectional, perspective close up view of a nozzle cutter with a portion of the bracket removed for viewing, exposing the trigger bar sharpened edge.

Referring now to FIG. 5, there is shown a side, sectional view of nozzle cutter (17), a portion of bracket (17) removed, exposing the front edge of trigger bar (32). Bracket hole (17*a*) aligns with lower rail hole (12*b*) permitting a nozzle to be inserted and then sliced by edge (32*c*). Front disk (18) includes a flange (18*b*) for securing a body of a cartridge when a nozzle is inserted into opening (18*a*).

Figure 6:
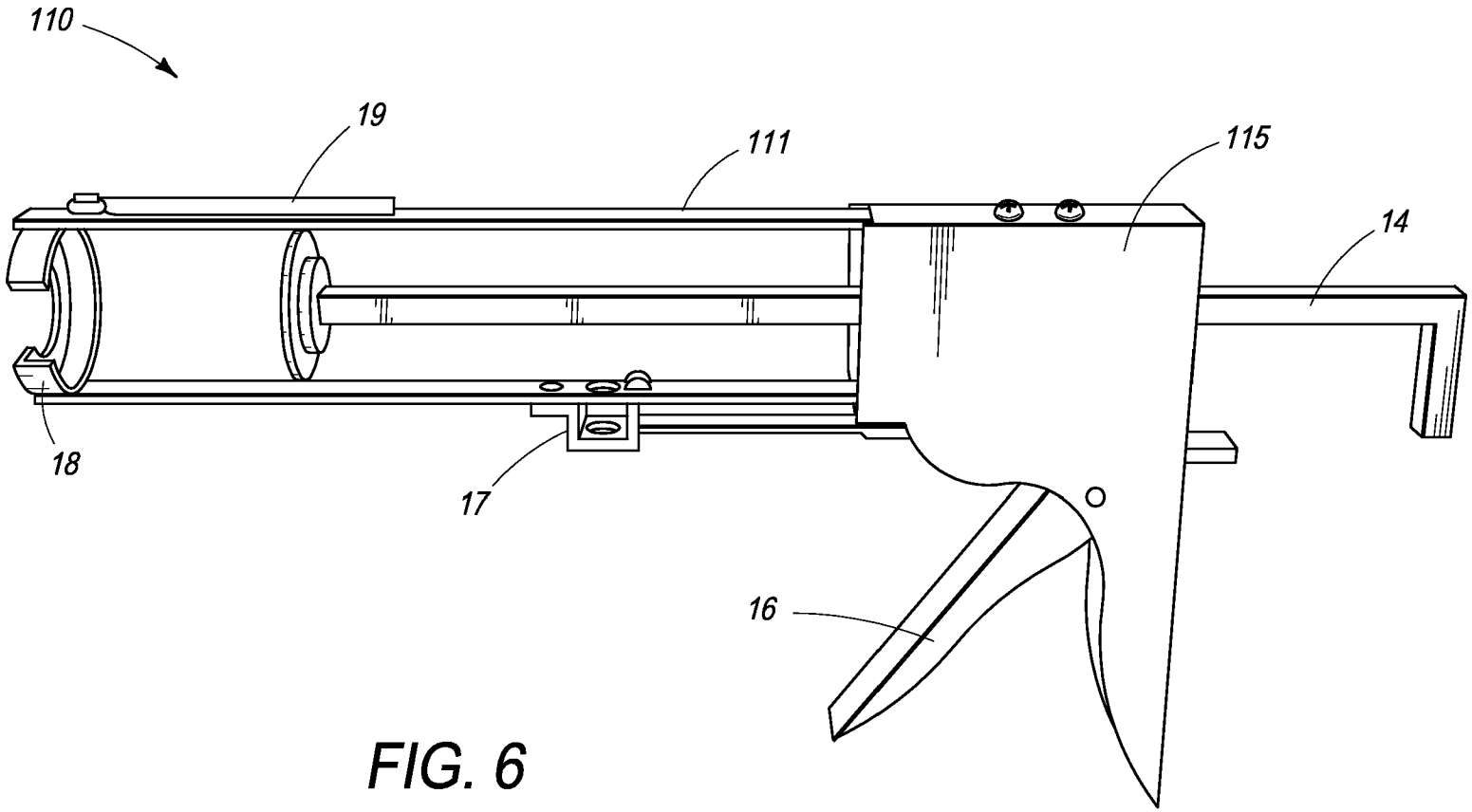
FIG. 6 is a side elevation, general view of a caulking gun with a stock with integrated non-sliding handle, a nozzle cutter still set away from said handle.

Referring now to FIG. 6, there is shown generally at (110) a caulking gun incorporating the actuating features of the invention with a non-sliding handle (115). Said gun includes a cartridge holder comprising disk (18); cartridge rail (111), said rail constructed to form both upper and lower portions of the cartridge rail as a continuous single piece; a plunger (14) a trigger (16); a nozzle cutter (17); and a cartridge poker (19).

Figure 7:
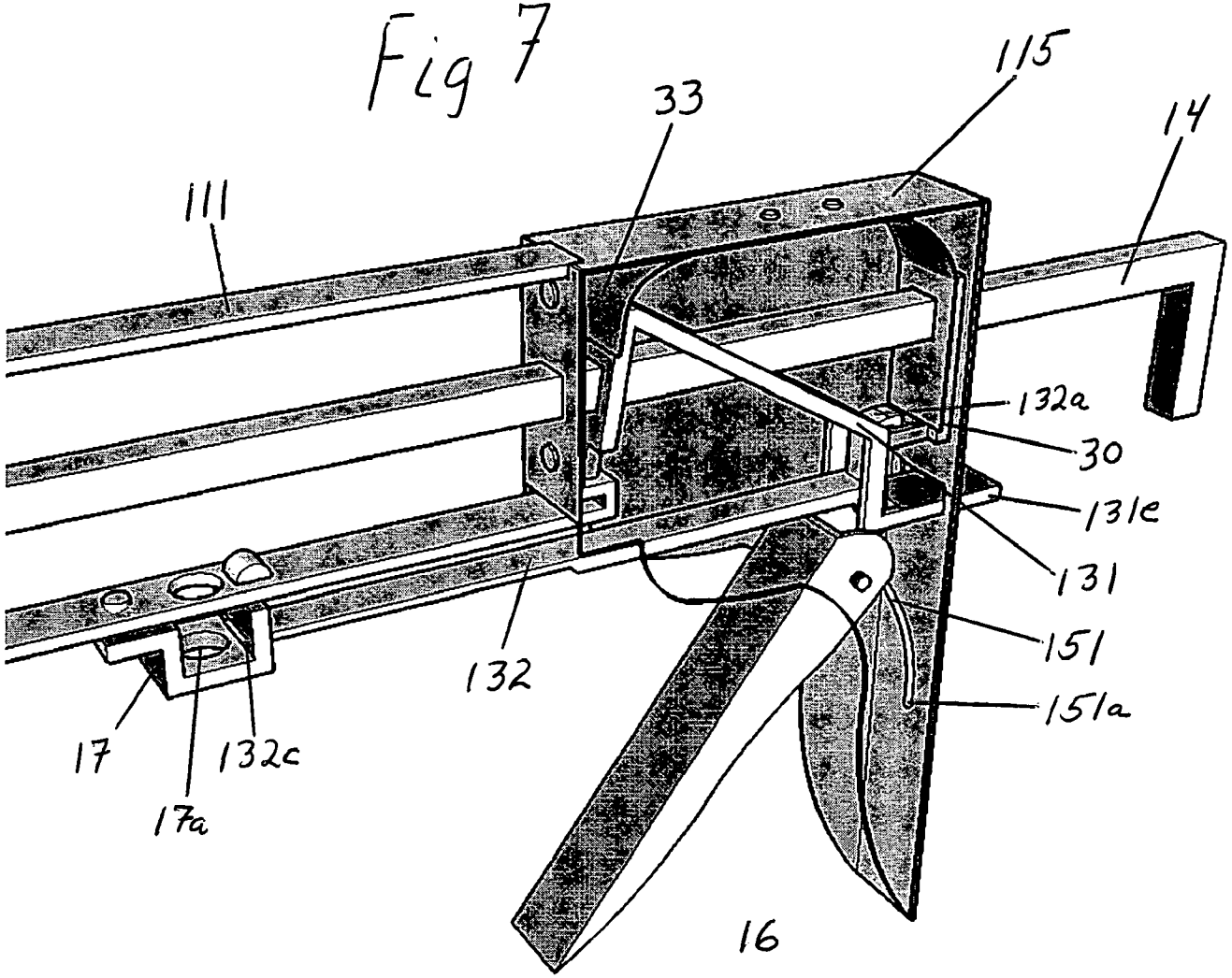
FIG. 7 is a side, sectional, perspective view of a caulking gun with a non-sliding handle, the side wall of said handle removed for viewing, exposing the hollow of a stock containing actuator plates, actuator leaf spring, plunger shaft and nozzle cutter.

Referring now to FIG. 7, there is shown a side, sectional, perspective view wherein cartridge rail (111) is formed from one continuous piece—forming both the upper and lower segments of the cartridge holder, the hollow of stock/handle (115) includes actuator spring (33), plunger advancing plate (30), a plunger restraining plate (131) with a terminating rear tab (131*e*) extending past the rear of stock/handle (115), and a rearward end (151*a*) of a trigger spring (151) bends downward contacting the inside of stock/handle (115). Trigger bar (132) has only 2 teeth (blocked by plate (131)) and enters brace (17). Brace (17) includes an opening (17*a*), and bar (132) includes sharpened edge/blade (132*c*), both forming a guillotine type cutter.

Figure 8:
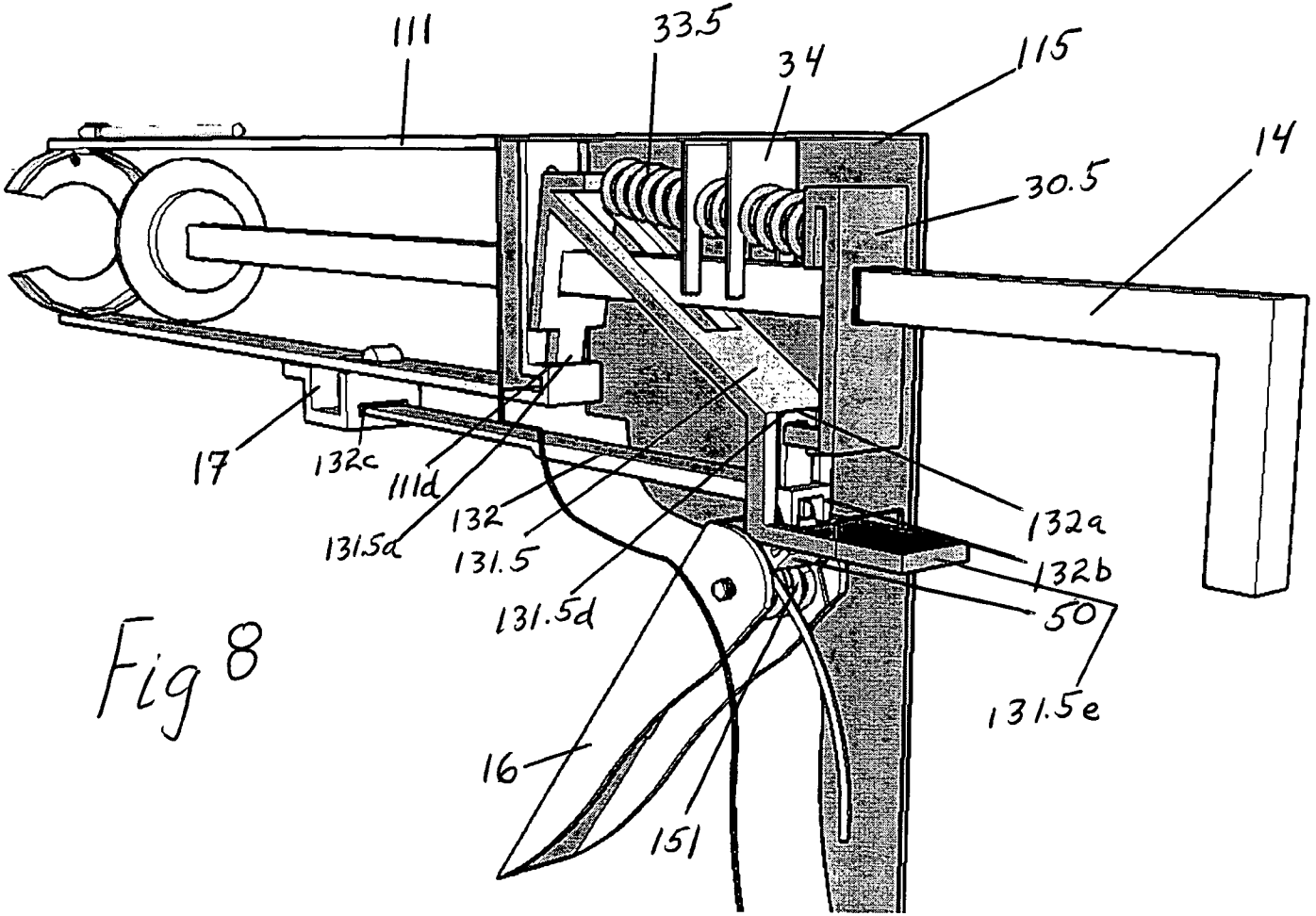
FIG. 8 is a side, sectional, perspective view of a caulking gun with a stock with integrated non-sliding handle, the side and rear walls of said handle removed for viewing, exposing a nozzle cutter, a trigger, a trigger spring, trigger extension, trigger bar, actuating plates, and actuator coil spring.

Referring now to FIG. 8, there is shown a side, sectional, perspective view of stock/handle (115), one side removed for viewing, a second embodiment of actuator coil spring (33.5) attached to stock/handle (115) with bracket (34). Plunger restraining plate (131.5) includes a tab (131.5*e*) that extends past the rear of stock/handle (115). Cartridge rail (111) is shown including hole (111*d*) into which foot (131.5*a*) of plate (131.5) is secured. Trigger bar (132) includes an upwardly sloped segment (132*a*) wherein said segment contacts and lifts plate (131.5) at point (131.5*d*), thus delaying plate (131.5) from restraining shaft (14) when trigger (16) is released after being squeezed.

The embodiments of the invention described herein are illustrative, rather than restrictive. Modification may be made without departing from the spirit of the invention as defined by the following claims and their equivalents.

What is claimed is:

1. A dispensing tool for dispensing material from a cartridge, the dispensing tool comprising:

a cartridge holder defining an opening sized to receive said cartridge, said cartridge holder including a cartridge rail having a plurality of indentations spaced along an axis thereof;

a plunger coupled to the cartridge holder such that it is movable axially through the cartridge holder opening;

a plunger restraining member coupled to the cartridge holder;

a repositionable handle coupled to the cartridge rail such that they are slidable relative to each other along the axis;

a handle repositioning lock releasably coupled between the cartridge rail and the repositionable handle; and a trigger pivotably coupled to the handle.

2. The dispensing tool of claim 1, wherein the handle repositioning lock comprises a forked tab engagable with the indentations so as to releasably lock the repositionable handle in place relative to the cartridge rail.

3. The dispensing tool of claim 1, wherein the indentations comprise teeth.

4. The dispensing tool of claim 1, wherein the lock is movable between a locked position, wherein the lock is engaged between the indentations of the cartridge rail and the handle to fix them in place relative to each other, and an unlocked position, wherein the indentations of the cartridge rail and the handle may slide axially along the axis relative to each other, and wherein the trigger is coupled to the handle repositioning lock such that, when the trigger is pivoted to a first pivot position, the handle repositioning lock moves to the unlocked position to allow the handle to slide axially relative to the cartridge rail.

5. The dispensing tool of claim 4, wherein the trigger is coupled to the handle repositioning lock such that, when the trigger is pivoted to a second pivot position different from the first pivot position, the handle repositioning lock moves to the locked position.

6. The dispensing tool of claim 1, further comprising a trigger bar disposed parallel to the cartridge rail and coupled to the trigger such that pivot of the trigger from a first pivot position to a second pivot position moves the trigger bar in a first direction and pivot of the trigger from the second pivot position to the first pivot position moves the trigger bar in a second direction opposite to the first direction.

7. The dispensing tool of claim 6, wherein the trigger bar comprises a cutting blade at an edge thereof.

8. The dispensing tool of claim 7, further comprising a surface extending parallel to the trigger bar and defining an opening spaced from the handle, the opening adjacent to the cutting blade when the trigger is in the first pivot position and overlapped by the cutting blade when the trigger is in the second position, the opening sized to receive a nozzle of said cartridge.

9. The dispensing tool of claim 1, further comprising an arm clip coupled to the cartridge rail and spaced from the handle, the arm clip sized to secure to a user's forearm.

10. The dispensing tool of claim 9, wherein the arm clip is pivotably coupled to the cartridge rail.

11. A dispensing tool for dispensing material from a cartridge, the dispensing tool comprising:

a cartridge holder defining an opening sized to receive said cartridge, said cartridge holder including a cartridge rail having indentations along an axis thereof;

a plunger coupled to the cartridge holder such that it is movable axially through the cartridge holder opening;

a plunger restraining member coupled to the cartridge holder and releasably engaged with the plunger so as to releasably restrain axial movement of the plunger through the cartridge holder opening;

a handle coupled to the cartridge rail;

a trigger pivotably coupled to the handle; and a trigger bar disposed parallel to the cartridge rail and coupled to the trigger such that pivot of the trigger from a first pivot position to a second pivot position moves the trigger bar in a first direction and pivot of the trigger from the second pivot position to the first pivot position moves the trigger bar in a second direction opposite to the first direction.

12. The dispensing tool of claim 11, further comprising:

a stock coupled to the cartridge holder; and an actuator spring fixed to the stock and exerting force on the plunger restraining member in a direction of engagement with the plunger to restrain axial movement of the plunger through the cartridge holder opening.

13. The dispensing tool of claim 11, wherein the handle is repositionable and slidably coupled to the cartridge rail, the dispensing tool further comprising a handle repositioning lock releasably coupled between the cartridge rail and the repositionable handle.

14. The dispensing tool of claim 11, wherein the trigger bar comprises a cutting blade at an edge thereof.

15. The dispensing tool of claim 14, further comprising a surface extending parallel to the trigger bar and defining an opening spaced from the handle, the opening adjacent to the cutting blade when the trigger is in the first pivot position and overlapped by the cutting blade when the trigger is in the second position, the opening sized to receive a nozzle of said cartridge.

16. The dispensing tool of claim 11, further comprising an arm clip coupled to the cartridge rail and spaced from the handle, the arm clip sized to secure to a user's forearm.

17. The dispensing tool of claim 16, wherein the arm clip is pivotably coupled to the cartridge rail.

18. A dispensing tool for dispensing material from a cartridge, the dispensing tool comprising:

a cartridge holder defining an opening sized to receive said cartridge, said cartridge holder including a cartridge rail having indentations along an axis thereof;

a plunger coupled to the cartridge holder such that it is movable axially through the cartridge holder opening;

a plunger restraining member coupled to the cartridge holder and releasably engaged with the plunger so as to releasably restrain axial movement of the plunger through the cartridge holder opening;

a handle coupled to the cartridge rail;

a trigger pivotably coupled to the handle;

a stock coupled to the cartridge holder; and an actuator spring fixed to the stock and exerting force on the plunger restraining member in a direction of engagement with the plunger to restrain axial movement of the plunger through the cartridge holder opening; and a plunger advancing member releasably engaged with the plunger so as to move the plunger axially through the cartridge holder opening in a first direction, and wherein the actuator spring exerts force on the plunger advancing member in a direction opposite to the first direction.

19. A dispensing tool for dispensing material from a cartridge, the dispensing tool comprising:

a cartridge holder defining an opening sized to receive said cartridge, said cartridge holder including a cartridge rail having indentations along an axis thereof;

a plunger coupled to the cartridge holder such that it is movable axially through the cartridge holder opening;

a plunger restraining member coupled to the cartridge holder and releasably engaged with the plunger so as to releasably restrain axial movement of the plunger through the cartridge holder opening;

a handle coupled to the cartridge rail; and a trigger pivotably coupled to the handle, wherein the trigger is coupled to the plunger and the plunger restraining member such that, when the trigger is pivoted to a first pivot position, the plunger restraining member releases engagement with the plunger to allow axial movement of the plunger and the plunger is moved axially through the cartridge holder opening in a first direction.

20. The dispensing tool of claim 19, wherein the trigger is further coupled to the plunger and the plunger restraining member such that, when the trigger is pivoted to a second pivot position different from the first pivot position, the plunger restraining member engages with the plunger to restrain axial movement of the plunger.

21. The dispensing tool of claim 20, wherein the trigger is coupled to the plunger restraining member such that, when the trigger is pivoted to the second pivot position, the plunger restraining member engages with the plunger after a delay, thereby allowing axial movement of the plunger before engagement.

22. The dispensing tool of claim 20, wherein the handle is repositionable and slidably coupled to the cartridge rail, the dispensing tool further comprising a handle repositioning lock releasably coupled between the cartridge rail and the repositionable handle, and wherein the trigger is further coupled to the handle repositioning lock such that, when the trigger is pivoted to a third pivot position, different from the first pivot position and the second pivot position, the handle repositioning lock disengages the repositionable handle and the cartridge rail to allow the handle to slide axially relative to the cartridge rail.

23. The dispensing tool of claim 19, wherein the handle is repositionable and slidably coupled to the cartridge rail, the dispensing tool further comprising a handle repositioning lock releasably coupled between the cartridge rail and the repositionable handle, and wherein the trigger is coupled to the handle repositioning lock such that, when the trigger is pivoted to the first pivot position, the handle repositioning lock engages the repositionable handle and the cartridge rail to fix the handle in place relative to the cartridge rail.

* * * * *